US007159275B2

(12) United States Patent
Chang

(10) Patent No.: US 7,159,275 B2
(45) Date of Patent: Jan. 9, 2007

(54) GLASS SURFACE CLEANING MACHINE

(76) Inventor: Marshall Chang, 7019 Pomelo Dr., Westhills, CA (US) 91307

( * ) Notice: Subject to any disclaimer, the term of this patent is extended or adjusted under 35 U.S.C. 154(b) by 522 days.

(21) Appl. No.: 10/464,943

(22) Filed: Jun. 18, 2003

(65) Prior Publication Data

US 2003/0208873 A1 Nov. 13, 2003

Related U.S. Application Data

(63) Continuation-in-part of application No. 09/905,602, filed on Jul. 13, 2001, now abandoned.

(51) Int. Cl.
*A47L 5/24* (2006.01)

(52) U.S. Cl. ..... 15/344; 15/353; 15/364; 15/401; 15/320

(58) Field of Classification Search ..... 15/320, 15/344, 353, 401, 364
See application file for complete search history.

(56) References Cited

U.S. PATENT DOCUMENTS 2,292,435 A * 8/1942 Crites ..... 15/321
3,290,716 A * 12/1966 Cain ..... 15/353
3,550,181 A * 12/1970 Burgoon et al. ..... 15/320
3,584,330 A * 6/1971 Wallin et al. ..... 15/375
4,817,233 A * 4/1989 Waldhauser ..... 15/320
5,386,612 A * 2/1995 Sham ..... 15/320
5,392,490 A * 2/1995 Monson ..... 15/320
5,819,365 A * 10/1998 Huffman et al. ..... 15/321
5,970,572 A * 10/1999 Thomas ..... 15/320
6,047,437 A * 4/2000 Suzuki ..... 15/320

* cited by examiner

*Primary Examiner*—Theresa T. Snider
(74) *Attorney, Agent, or Firm*—Raymond Y. Chan; David & Raymond Patent Firm

(57) ABSTRACT

A glass surface cleaning machine includes a supporting frame which has a fluid receiving chamber provided therein and includes a supporting arm frontwardly extended therefrom, a wiper blade transversely mounted on a front edge of the supporting arm of the supporting frame for wiping on a glass surface, and a vacuum device supported by the supporting frame. The vacuum device includes at least a fluid suction nozzle supported underneath the wiper blade and in communication with the fluid receiving chamber and an impeller to create a low pressure within the fluid receiving chamber with respect to the atmosphere pressure so as to create a sucking effect for removing fluid from the glass surface through the fluid suction nozzle and directing the fluid to deposit in the fluid receiving chamber.

32 Claims, 7 Drawing Sheets

GLASS SURFACE CLEANING MACHINE

CROSS REFERENCE OF RELATED APPLICATION

This is a Continuation-In-Part application of a non-provisional application, application Ser. No. 09/905,602, filed Jul. 13, 2001, which is now abandoned.

BACKGROUND OF THE PRESENT INVENTION

1. Field of Invention

The present invention relates to cleaning apparatus, and more particularly to a glass surface cleaning machine which is adapted for cleaning a glass surface wherein the residual cleaning water along the wiper blade is sucked into a fluid receiving chamber of the cleaning machine to prevent water stain to be remained on the glass surface.

2. Description of Related Arts

Conventionally, a wiper is commonly used to clean a glass surface. Generally, a detergent, such as soap water, is first applied on the glass surface for removing dirt thereon. Sometimes, clean water is further used to wash off the soap water on the glass surface. Then, the wiper is used to wipe off the residual cleaning water on the glass surface so as to prevent water stained on the cleaned glass surface.

However, the wiper has a relative small size with respect to the glass surface such that water will stain on the glass surface along two ends of the wiper while wiping the glass surface. So, a cleaner must dry or clean the wiper every time after each wiping and keep repeatedly wiping the glass surface until all water is removed from the glass surface. If any water is not removed on the glass surface and/or the wiper, watermarks will remain on the glass surface. Practically, it is more difficult to clean the watermarks later. Thus, it not only is a hassle for drying the water on the wiper but also takes more time to clean the glass surface.

Especially, when the cleaner needs to clean the glass surfaces of a tower building, he or she must be hung over the tower for a period of time. When the glass wall surfaces are very dirty, the cleaner must take time to mop up the dirt on the glass wall surfaces. It is a dangerous task for the cleaner to stay over the tower for a long period of time.

SUMMARY OF THE PRESENT INVENTION

A main object of the present invention is to provide a glass surface cleaning machine which can clean a glass surface efficiently by removing the residual cleaning water along the wiper blade.

Another object of the present invention is to provide a glass surface cleaning machine, which can be used for sucking the water along the wiper blade so as to prevent watermark stained on the glass surface.

Another object of the present invention is to provide a glass surface cleaning machine which merely requires one simple single slide-down action to operate rubbing, wiping and water drying on the glass surface simultaneously.

Another object of the present invention is to provide a glass surface cleaning machine which comprises a mop roller adapted for automatically cleaning the glass surface while wiping the glass surface at the same time.

Accordingly, in order to accomplish the above objects, the present invention provides a glass surface cleaning machine for cleaning a glass surface, comprising:

a supporting frame having a fluid receiving chamber provided therein and comprising a supporting arm frontwardly extended therefrom;

a wiper blade transversely mounted on a front edge of the supporting arm of the supporting frame for removing fluid on the glass surface;

a vacuum device, supported by the supporting frame, comprising:

at least a fluid suction nozzle supporting underneath the wiper blade and being in communication with the fluid receiving chamber; and an impeller supported by the supporting frame for creating a low pressure within the fluid receiving chamber with respect to an atmosphere pressure, so as to create a sucking effect at the fluid suction nozzle for sucking the fluid along the wiper blade into the fluid receiving chamber through the fluid suction nozzle; and a mop device comprising a mop roller which is rotatably supported underneath the supporting frame and powered by the impeller for mopping up the glass surface.

These and other objectives, features, and advantages of the present invention will become apparent from the following detailed description, the accompanying drawings, and the appended claims.

DETAILED DESCRIPTION OF THE PREFERRED EMBODIMENT

Figure 1:
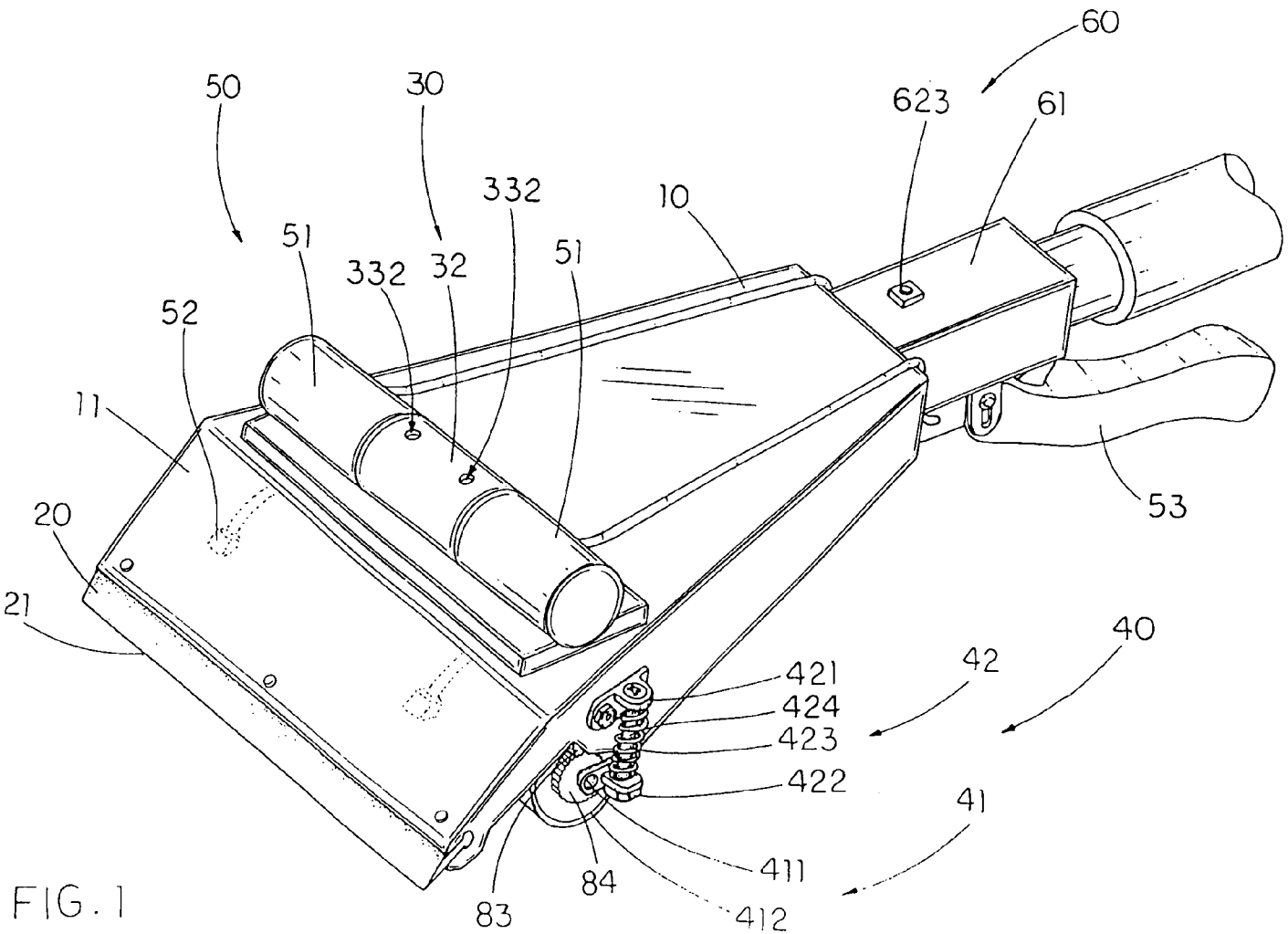
FIG. 1 is a perspective view of a glass surface cleaning machine according to a preferred embodiment of the present invention.

Referring to FIGS. 1 to 6 of the drawings, a glass surface cleaning machine according to a preferred embodiment of the present invention is illustrated, wherein the glass surface cleaning machine comprises a supporting frame 10, a wiper blade 20 and a vacuum device 30. The supporting frame 10 has a fluid receiving chamber 101 provided therein and comprises a supporting arm 11 frontwardly extended therefrom. The fluid receiving chamber 101 has an outlet opening 102, which is normally shut by a detachable cover 103, for pouring out the fluid stored in the fluid receiving chamber 101. The wiper blade 20 is transversely mounted on a front edge of the supporting arm 11 of the supporting frame 10 for wiping on a glass surface S.

Figure 2:
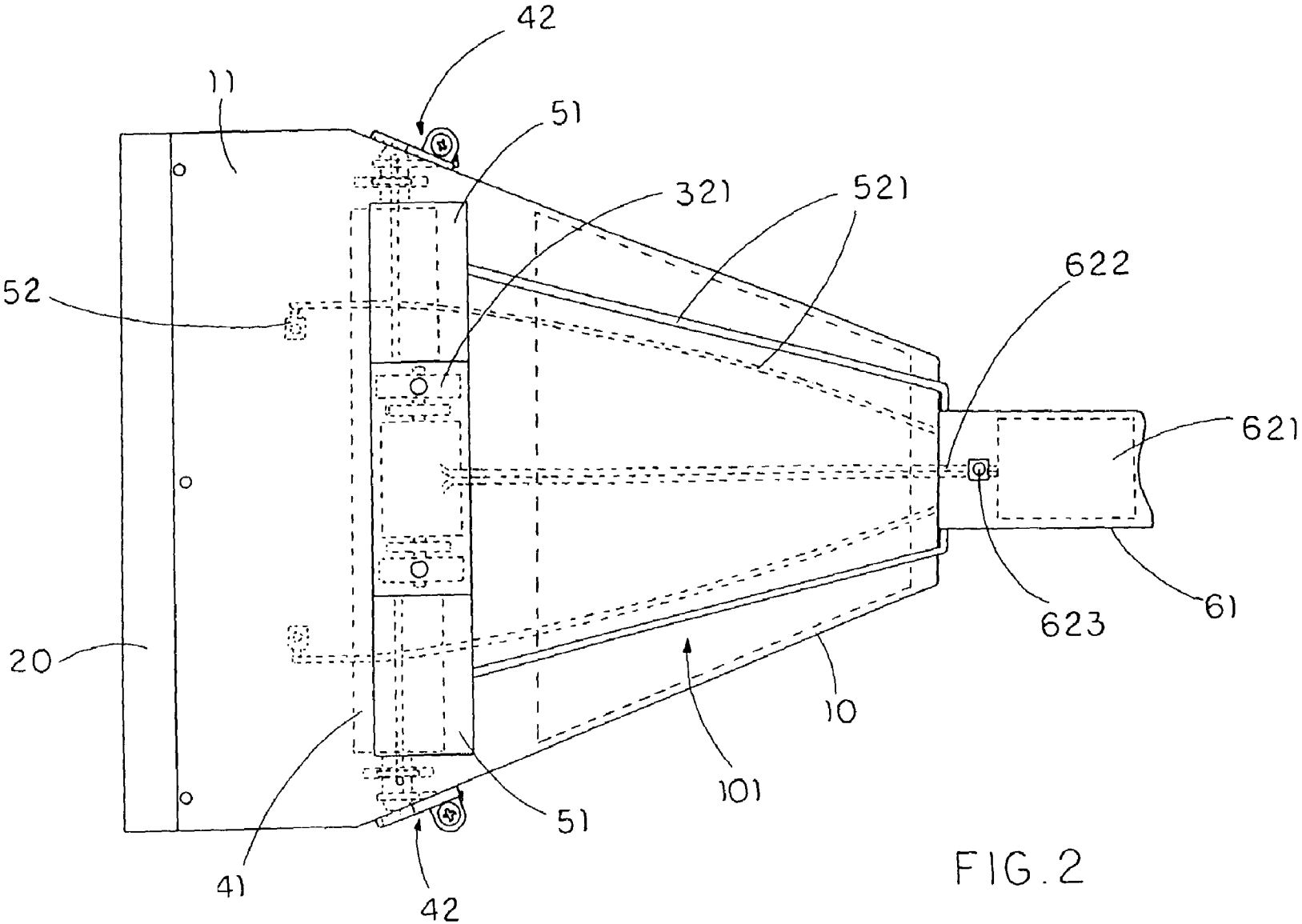
FIG. 2 is a top sectional view of the glass surface cleaning machine according to the above preferred embodiment of the present invention.
Figure 3:
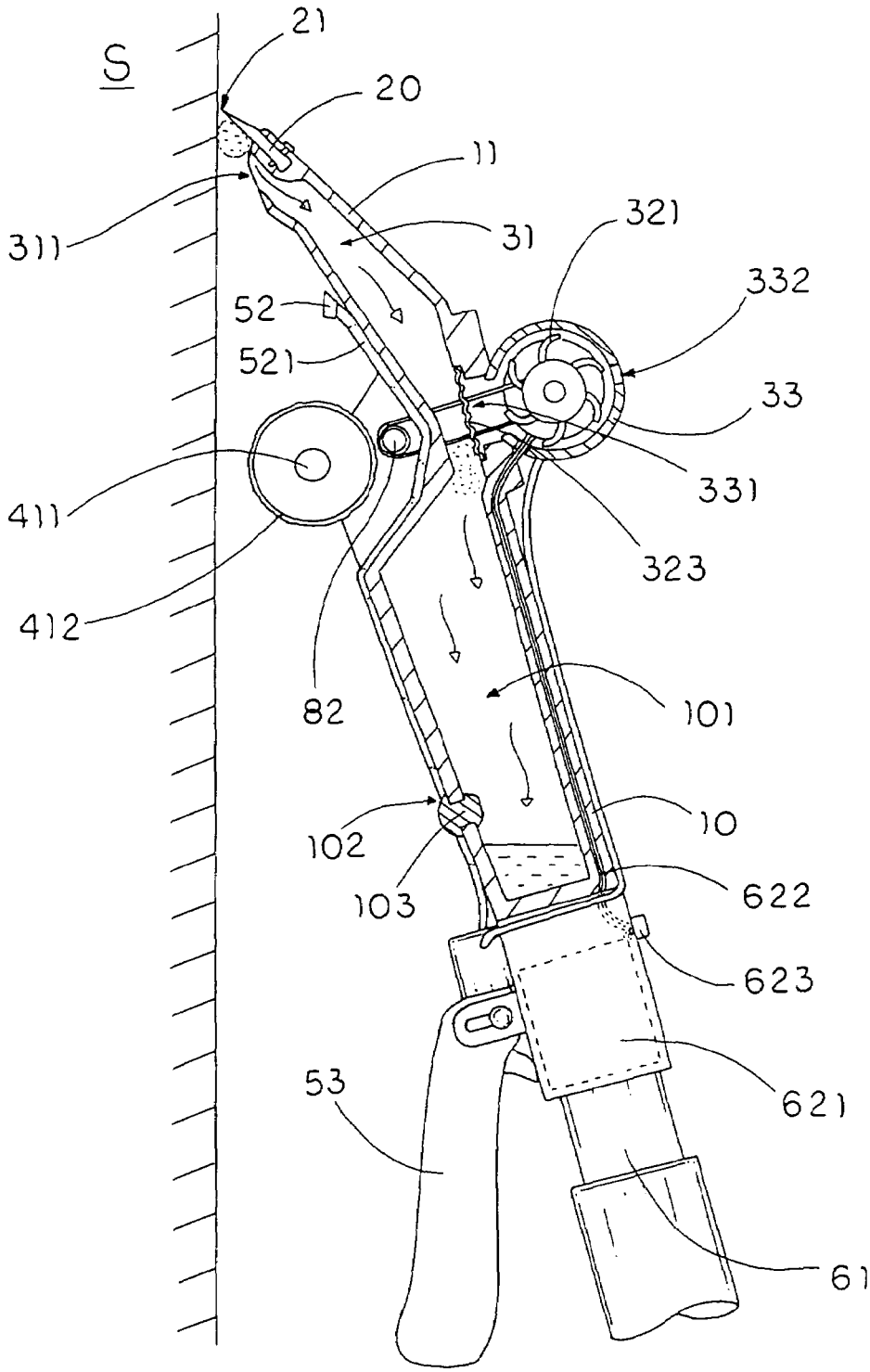
FIG. 3 is a side sectional view of the glass surface cleaning machine according to the above preferred embodiment of the present invention.

As shown in FIGS. 2 and 3, the vacuum device 30, which is supported by the supporting frame 10, comprises at least a fluid suction nozzle 31 and a power source 32. The fluid suction nozzle 31 is supported underneath the wiper blade 20 and in communication with the fluid receiving chamber 101. The power source 32 is a motor that powers at least an impeller 321 to create a low pressure on one side of the impeller 321 and a high pressure on another side of the impeller 321. In other words, the impeller 321 is arranged to create the low pressure within the fluid receiving chamber 101 with respect to the atmosphere pressure so as to create a sucking force for removing any fluid from the glass surface S through the fluid suction nozzle 31 and directing the fluid to deposit in the fluid receiving chamber 101.

As shown in FIG. 3, the vacuum device 30 further comprises an impeller housing 33 supported on the supporting frame 10 to receive the impeller 321 in the impeller housing 33, wherein the impeller housing 33 has an air inlet 331 communicating with the fluid receiving chamber 101 and an air outlet 332 arranged for discharging any air within the fluid receiving chamber 101 through the impeller housing 33 when the sucking effect is created by the impeller housing 33. Accordingly, an air filter 323 is provided at the air inlet 332 of the impeller housing 33 for allowing the air within the fluid receiving chamber 101 to pass into the impeller housing 33.

The supporting arm 11 is integrally extended from a front portion of the supporting frame 10, wherein the supporting arm 11 is constructed to form a hollow body to define the fluid suction nozzle 31 therein. The fluid suction nozzle 31 has a front end extended frontwardly to form a suction opening 311 positioned adjacent to a rear side of the wiper blade 20 and a rear end extended rearwardly to communicate with the fluid receiving chamber 101.

The wiper blade 20, which is made of rubber, is firmly attached to the front edge of the supporting arm 11 of the supporting frame 10 wherein the wiper blade 20, such as a standard wiper, has a front tip edge 21 adapted for removing fluid on the glass surface S in a scraping manner. It is worth to mention that since the wiper blade 20 is made of rubber, the fluid stays along the wiper blade 20 by means of surface tension of the fluid when the wiper blade 20 wipes on the glass surface S. Therefore, the fluid along the wiper blade 20, especially at two ends of the wiper blade 20, is sucked into the fluid receiving chamber 101 through the fluid suction nozzle 31.

According to the preferred embodiment, the fluid along the wiper blade 20 is sucked into the fluid receiving chamber 101 through the suction opening 311, the fluid may stay around the air filter 323 by means of the sucking effect. However, the air filter 323 blocks the fluid from entering into the impeller housing 33. Therefore, once a predetermined volume of the fluid accumulates within the fluid receiving chamber 101 around the air filter 323, the fluid will drop down to the bottom portion of the fluid receiving chamber 101 by gravity, as shown in FIG. 3.

As shown in FIG. 3, the glass cleaning machine further comprises a mop device 40 which comprises a mop roller 41 transversely and rotatably mounted underneath the supporting arm 11 for mopping up the glass surface S in a rotatably movable manner.

The mop roller 41, according to the preferred embodiment, comprises an elongated central axle 411 rotatably supported underneath the supporting arm 11 and a mopping element 412 encircling the central axle 411 adapted for adsorbing detergent fluid such as soap water and rolling and rubbing against the glass surface S to clean the glass surface S.

The mopping element 412, which is a sponge sleeve having a predetermined thickness, is used for cleaning the glass surface S and/or absorbing fluid on the glass surface S. In other words, the mop roller 41 is capable of not only cleaning the glass surface S individually but also absorbing fluid on the glass surface S before wiping by the wiper blade 20, so as to prevent extra fluid remaining on the wiper blade 20 and stain on the glass surface S.

Figure 4A:
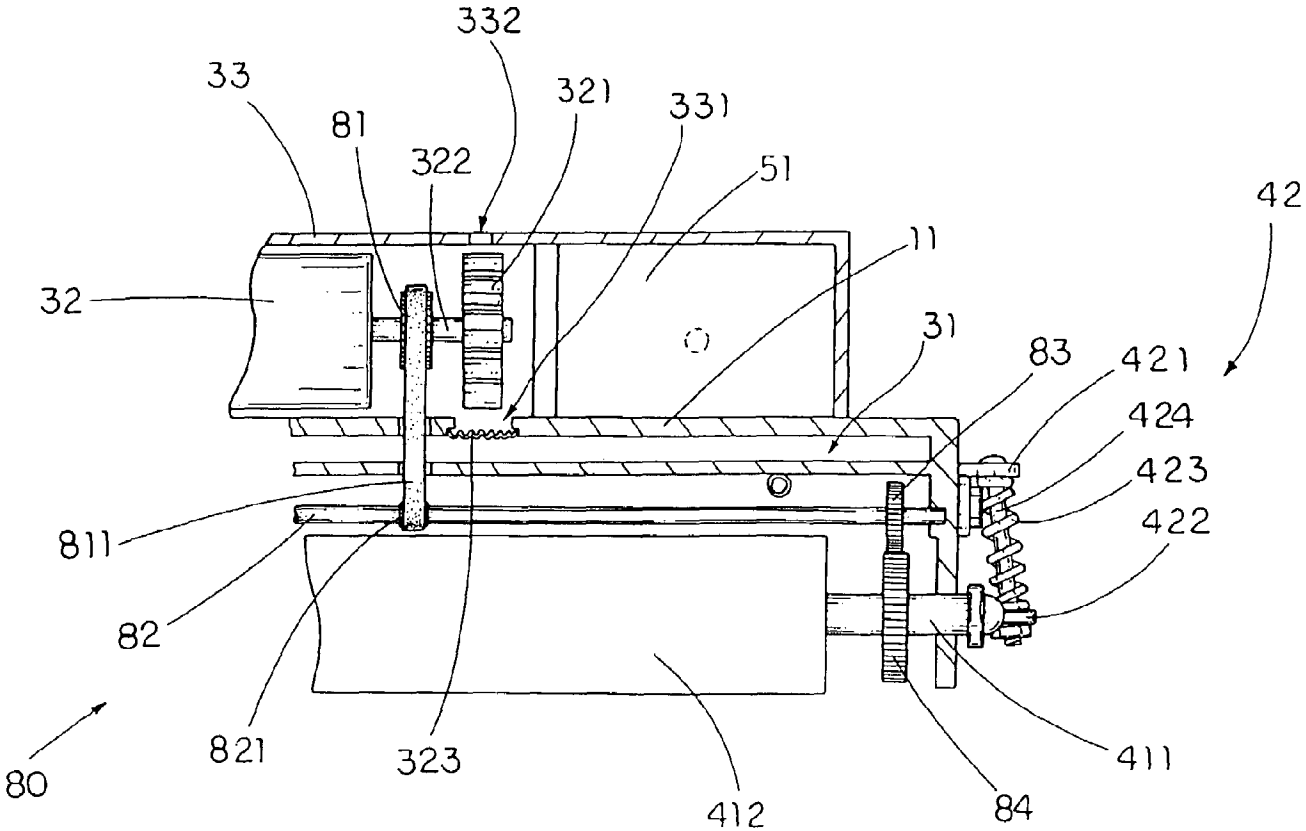
FIG. 4A is a partially sectional view of the glass surface cleaning machine according to the above preferred embodiment of the present invention.
Figure 4B:
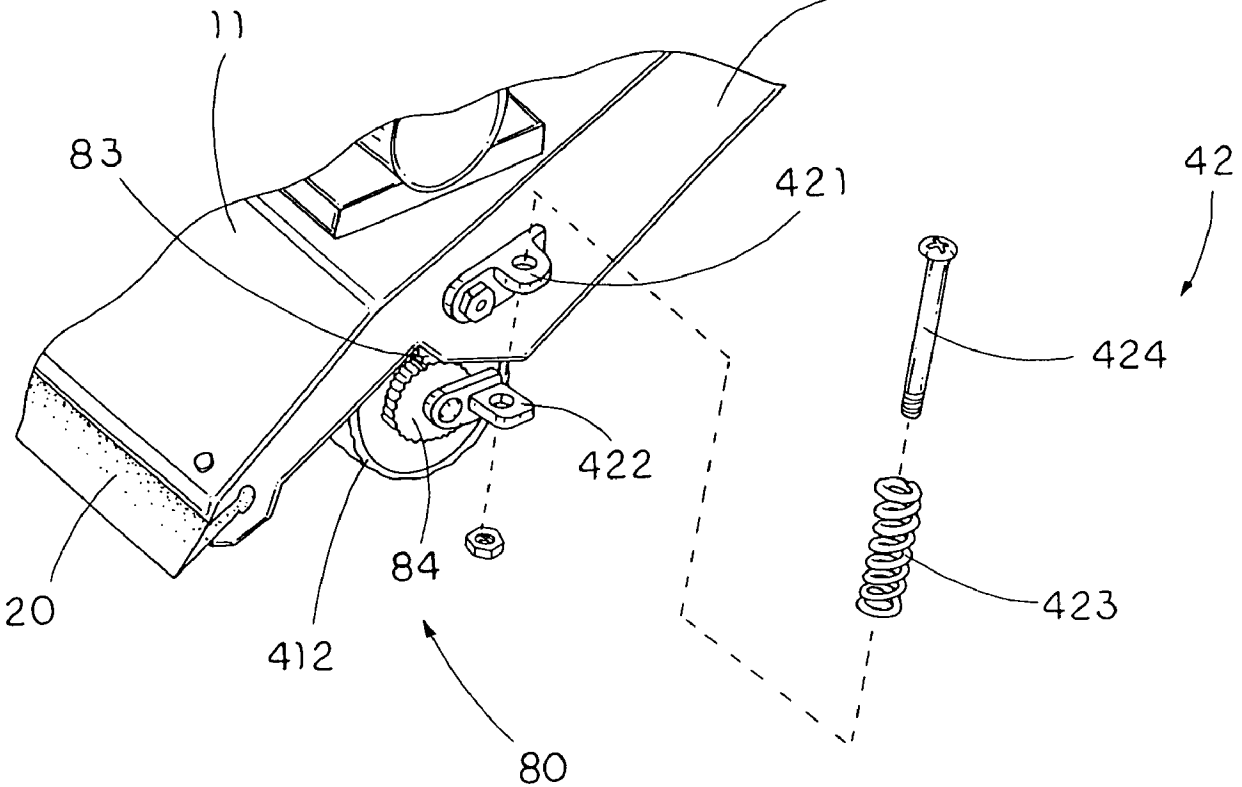
FIG. 4B is an exploded perspective view of the coupling joint of the glass surface cleaning machine according to the above preferred embodiment of the present invention.

According to the present invention, as shown in FIGS. 3, 4A and 4B, the mop device 40 can be powered by the power source 32 of the vacuum device 30, wherein at least one end of the central axle 411 is rotatably connected to an output axle 322 of the power source 32 via a rotary gear unit 80 so as to drive the mop roller 41 to rotate automatically.

The rotary gear unit 80 comprises a first gear 81 coaxially attached to the output axle 322 of the power source 32, a transmission shaft 82, having a second gear 821, transversely supported by the supporting frame 10 wherein the second gear 821 is driven to rotate by the first gear 81 via a transmitting belt 811, a third gear 83 coaxially attached to an end portion of the rotary shaft 82, and a fourth gear 84 coaxially attached to the central axle 411 and arranged to engage with the third gear 83. Therefore, the transmission shaft 82 is driven to rotate by the output axle 322 of the power source 32 through the first and second gears 81, 821, so as to drive the central axle 411 to rotate through the third and fourth gears 83, 84.

The mop device 40 further comprises means 42 for retaining the rotary gear unit 80 in a rotatably engaging manner. A shown in FIGS. 1 and 4, the retaining means 42 are a pair of coupling joints connecting the central axle 411 with the supporting frame 10 in a movable manner. Each of the coupling joints of the retaining means 42 comprises a first member 421, having a first through hole, affixed to a sidewall of the supporting frame 10, a second member 422, having a second through hole, affixed to an end of the central axle 411, a retaining arm 424 slidably connecting the first member 421 with the second member 422 to retain a distance between the first and second members 421, 422, and a resilient element 423 mounted between the first and second members 421, 422 for applying an urging pressure against the second member 422 so as to ensure the fourth gear 84 rotatably engaging with the third gear 83.

As shown in FIG. 4B, the retaining arm 424 has two end portions slidably passing through first and second through holes of the first and second members 421, 422 respectively to retain the distance between the first and second members 421, 422, so as to retain the engagement between the third and fourth gears 83, 84.

According to the present invention, the resilient element 423 is a compression spring coaxially mounted on the retaining arm 424 and having two ends biasing against the first and second members 421, 422 respectively to push the mop roller 41 away from the supporting arm 11. It is worth to mention that when the mop roller 41 presses on the glass surface S, the fourth gear 84 may be moved at an offset position that the fourth gear 84 is disengaged with the third gear 83. However, the resilient element 423 is capable of applying the urging pressure to push the second member 422 to its original position that the fourth gear 84 is engaged with the third gear 83 so as to ensure that engagement between the third and fourth gears 83, 84. In other words, the mop roller 41 is capable of self-adjustably pressing against the glass surface S to enhance a full contact between the mopping element 412 and the glass surface S.

The glass cleaning machine further comprises a fluid spray device 50 comprises at least a fluid detergent supply bin 51 supported by the supporting frame 10, at least a spray head 52 mounted on the supporting arm 11 and operatively communicating with the fluid detergent supply bin 51 via a conduit 521, and an operation trigger 53 arranged to be operated for ejecting the fluid detergent in the fluid detergent supply bin 51 on the glass surface S through the spray head 52, as shown in FIG. 2.

For heavy duty work, such as cleaning a tower building which has hundreds of glass surface S, the glass cleaning machine preferably comprises an operation device 60 which includes an extension frame 61 and a control means 62 for controlling the vacuum device 30, as shown in FIG. 2.

The extension frame 61 is detachably attached to a rear portion of the supporting frame 10 for extending a handle portion of the supporting frame 10 so as to enhance the cleaning area of the glass surface S via the extension frame 61.

The control means 62 comprises a rechargeable power supply 621 disposed in the extension frame 61 and electrically connected to the power source 32 of the vacuum device 30 via connecting wires 622, and a control switch 623 for selectively controlling the power source 32 in an on and off manner. So, the user can effectively clean up the glass surfaces S of the tower and reduce the cleaning time.

Figure 5:
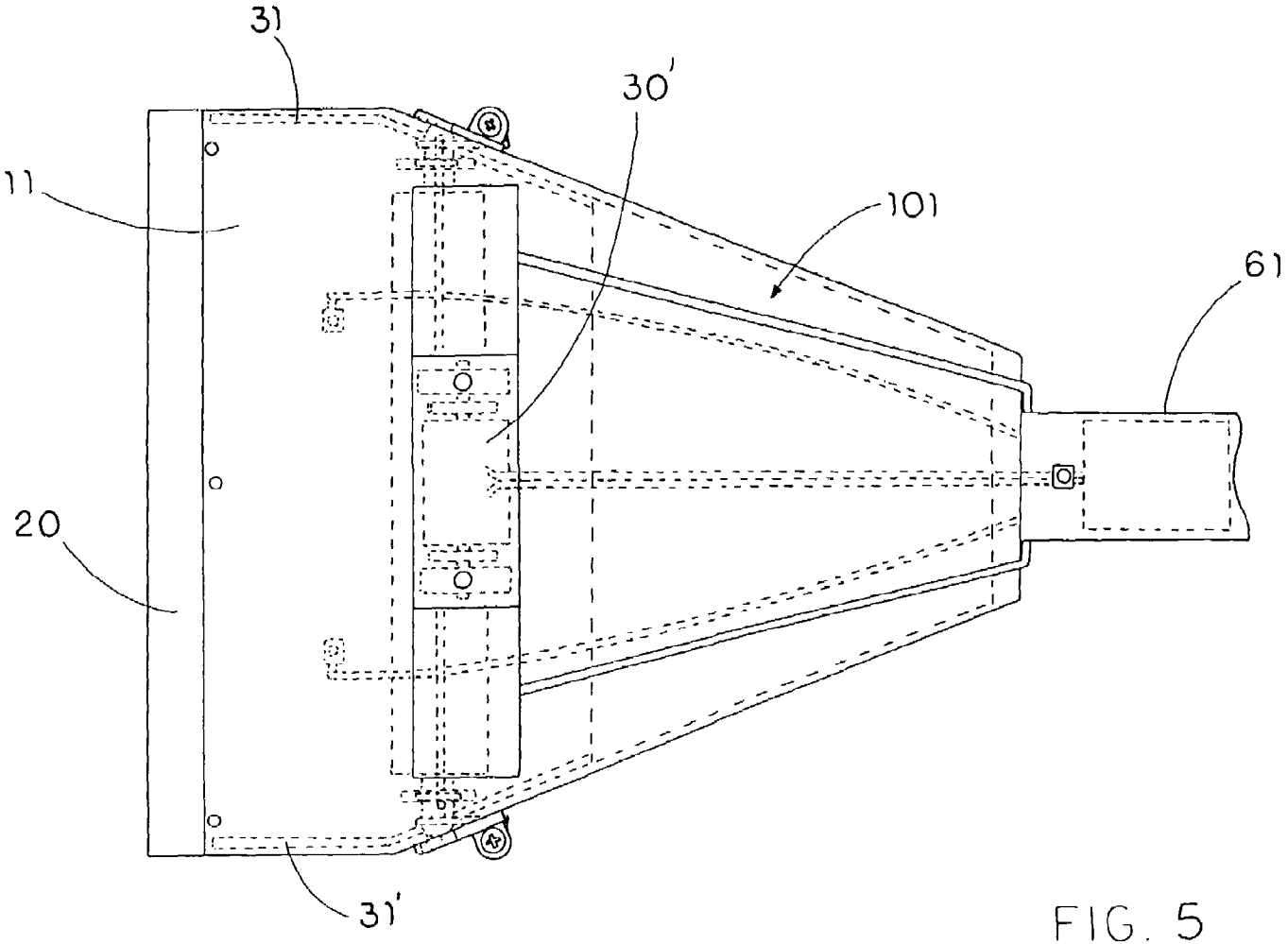
FIG. 5 illustrates an alternative mode of a vacuum device of the glass surface cleaning machine according to the above preferred embodiment of the present invention.

FIG. 5 illustrates an alternative mode of the vacuum device 30' of the glass surface cleaning machine of the above preferred embodiment, wherein the vacuum device 30' comprises a pair of tubular fluid suction nozzles 31' extended from the fluid receiving chamber 101 to two sides of the front edge of the supporting arm 11 respectively. During wiping operation, water normally stays on two side ends of the wiper blade 20. So, the two fluid suction nozzles 31' are adapted for removing the water at two side ends of the wiper blade 20 so as to prevent the water stained on the glass surface S.

Figure 6:
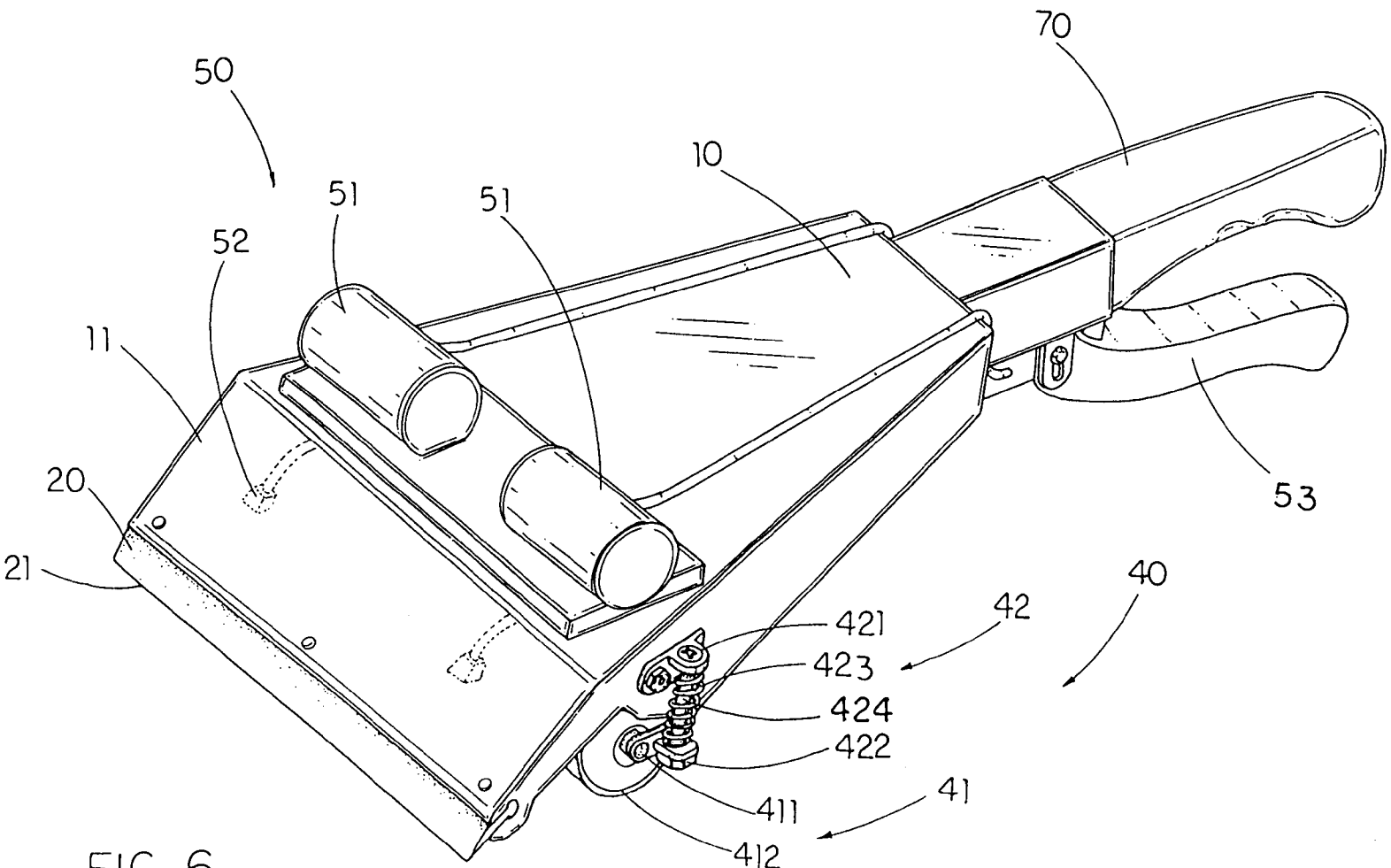
FIG. 6 illustrates an alternative mode of the glass surface cleaning machine according to the above preferred embodiment of the present invention.

For home usage, the user may be a housewife who may not need a powered cleaning machine such that the glass surface cleaning machine preferably comprises a handle frame 70 rearwardly extended from the rear portion of the supporting frame 10. It is worth to mention that the glass surface cleaning machine can be simply constructed without the power source 32 for household usage so as to reduce the overall weight of the glass surface cleaning machine such that the cleaner can easily operate the present invention manually, as shown in FIG. 6.

Accordingly, the user may press the mopping element 412 of the mop roller 41 against the glass surface S and rub the mop roller 41 up and down to clean the glass surface S. The resilient elements 423 of the retaining means 42 will provide a resistant force to ensure the mop roller 41 pressing against the glass surface. In order to achieve better cleaning effect, the user may also operate the fluid spray device 50 to supply fluid detergent from the fluid detergent supply bin 51 onto the glass surface S through the spray head 52 by controlling the operation trigger 53.

FIG. 3 illustrates the glass cleaning machine working on a vertical glass surface S. Since wiper blade 20 and the suction opening 311 is positioned right above the mop roller 41, when the mop roller 41 rolls downwardly to rub and clean the glass surface S, cleaning water may remain on the rubbed glass surface and the glass cleaning machine can substantially clean such cleaning water remained on the glass surface S at the same time during the downwardly continuous wiping motion of the glass cleaning machine. Practically, when the mop roller 41 rolls and rubs from an upper portion to a lower portion of the glass surface S to clean it, the wiper blade 21 will be positioned right at that upper portion of the glass surface S to wipe over that upper portion of the glass surface S so as to wipe off the residual fluid detergent or cleaning water remained thereon to a rear side of the wiper blade, and then the suction opening 311 which is positioned just adjacent to the rear side of the wiper blade 20 will suck up such residual fluid detergent or any cleaning water to store in the fluid receiving chamber 101. In other words, the cleaning of the glass surface and the removal of the cleaning fluid along the wiper blade 20 can be completed at the same time simply by a single action of rubbing the glass cleaning machine downwardly against the glass surface S.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A glass surface cleaning machine, comprising:

a supporting frame having a fluid receiving chamber provided therein and comprising a supporting arm frontwardly extended therefrom;

a wiper blade transversely mounted on a front edge of said supporting arm of said supporting frame; and a vacuum device, supported by said supporting frame, comprising:

at least a fluid suction nozzle communicating with said fluid receiving chamber and having a suction opening extended to position underneath said wiper blade; and a suction means for providing a sucking force at said suction opening of said fluid suction nozzle, wherein said suction means comprises a power source arranged to drive an impeller to create a low pressure within said fluid receiving chamber with respect to an atmosphere pressure so as to create said suction force at said suction opening adapted for removing any fluid existed along said wiper blade around said suction opening through said fluid suction nozzle and directing said fluid to deposit in said fluid receiving chamber, wherein said suction means further comprises an impeller housing supported on said supporting frame to receive said impeller, wherein said impeller housing has an air inlet communicating with said fluid receiving chamber and an air outlet arranged for discharging an air within said fluid receiving chamber through said impeller housing to create said suction force, wherein said suction means further comprises an air filter provided at said air inlet of said impeller housing for allowing said air within said fluid receiving chamber to pass into said impeller housing so as to prevent said fluid from entering thereinto.

2. A glass surface cleaning machine, as recited in claim 1, wherein said supporting arm is integrally extended from a front portion of said supporting frame and constructed to form a hollow body to define said fluid suction nozzle therein, wherein said fluid suction nozzle has a front end extended frontwardly to form said suction opening positioned adjacent to a rear side of said wiper blade and a rear end extended rearwardly to communicate with said fluid receiving chamber.

3. The glass surface cleaning machine, as recited in claim 2, wherein said wiper blade which is made of rubber is firmly attached to said front edge of said supporting arm of said supporting frame wherein said wiper blade has a front tip edge.

4. The glass surface cleaning machine, as recited in claim 3, further comprises a fluid spray device which comprises at least a fluid detergent supply bin supported by said supporting frame, at least a spray head mounted on said supporting arm and operatively communicating with said fluid detergent supply bin via a conduit, and an operation trigger arranged to be operated for ejecting fluid detergent in said fluid detergent supply bin through said spray head.

5. The glass surface cleaning machine, as recited claim 4, further comprising an operation device which includes an extension frame and a control means for controlling said vacuum device, wherein said extension frame is detachably attached to a rear portion of said supporting frame to extend a handle portion of said supporting frame and said control means comprises a rechargeable power supply disposed in said extension frame and electrically connected to said power source of said suction means, and a control switch for selectively controlling said power source to power on and off.

6. The glass surface cleaning machine, as recited in claim 5, further comprising a mop device which comprises a mop roller transversely and rotatably mounted underneath said supporting arm, wherein said mop roller comprises an elongated central axle rotatably supported underneath said supporting arm and a mopping element encircling said central axle.

7. The glass surface cleaning machine, as recited in claim 6, wherein said mop device is also powered by said power source of said suction means, wherein one end of said central axle is rotatably connected to an output axle of said power source via a rotary gear unit so as to drive said mop roller to rotate automatically.

8. The glass surface cleaning machine, as recited in claim 7, wherein said mop device further comprises means for retaining said rotary gear unit in a rotatably engaging manner.

9. The glass surface cleaning machine, as recited in claim 6, wherein said mop device further comprises means for retaining said rotary gear unit in a rotatably engaging manner.

10. The glass surface cleaning machine, as recited in claim 3, further comprising a mop device which comprises a mop roller transversely and rotatably mounted underneath said supporting arm, wherein said mop roller comprises an elongated central axle rotatably supported underneath said supporting arm and a mopping element encircling said central axle.

11. The glass surface cleaning machine, as recited in claim 10, wherein said mop device is also powered by said power source of said suction means, wherein one end of said central axle is rotatably connected to an output axle of said power source via a rotary gear unit so as to drive said mop roller to rotate automatically.

12. The glass surface cleaning machine, as recited in claim 11, wherein said mop device further comprises means for retaining said rotary gear unit in a rotatably engaging manner.

13. The glass surface cleaning machine, as recited in claim 10, wherein said mop device further comprises means for retaining said rotary gear unit in a rotatably engaging manner.

14. The glass surface cleaning machine, as recited in claim 1, wherein said vacuum device further comprises a second fluid suction nozzle, wherein said two fluid suction nozzles are two tubular nozzles extended from said fluid receiving chamber to two sides of said front edge of said supporting arm respectively, wherein a front end of each of said two fluid suction nozzles forms said suction opening.

15. The glass surface cleaning machine, as recited in claim 14, wherein said wiper blade which is made of rubber is firmly attached to said front edge of said supporting arm of said supporting frame wherein said wiper blade has a front tip edge.

16. The glass surface cleaning machine, as recited in claim 15, further comprises a fluid spray device which comprises at least a fluid detergent supply bin supported by said supporting frame, at least a spray head mounted on said supporting arm and operatively communicating with said fluid detergent supply bin via a conduit, and an operation trigger arranged to be operated for ejecting fluid detergent in said fluid detergent supply bin through said spray head.

17. The glass surface cleaning machine, as recited claim 16, further comprising an operation device which includes an extension frame and a control means for controlling said vacuum device, wherein said extension frame is detachably attached to a rear portion of said supporting frame to extend a handle portion of said supporting frame and said control means comprises a rechargeable power supply disposed in said extension frame and electrically connected to said power source of said suction means, and a control switch for selectively controlling said power source to power on and off.

18. The glass surface cleaning machine, as recited in claim 17, further comprising a mop device which comprises a mop roller transversely and rotatably mounted underneath said supporting arm, wherein said mop roller comprises an elongated central axle rotatably supported underneath said supporting arm and a mopping element encircling said central axle.

19. The glass surface cleaning machine, as recited in claim 18, wherein said mop device is also powered by said power source of said suction means, wherein one end of said central axle is rotatably connected to an output axle of said power source via a rotary gear unit so as to drive said mop roller to rotate automatically.

20. The glass surface cleaning machine, as recited in claim 19, wherein said mop device further comprises means for retaining said rotary gear unit in a rotatably engaging manner.

21. The glass surface cleaning machine, as recited in claim 18, wherein said mop device further comprises means for retaining said rotary gear unit in a rotatably engaging manner.

22. The glass surface cleaning machine, as recited in claim 15, further comprising a mop device which comprises a mop roller transversely and rotatably mounted underneath said supporting arm, wherein said mop roller comprises an elongated central axle rotatably supported underneath said supporting arm and a mopping element encircling said central axle.

23. The glass surface cleaning machine, as recited in claim 22, wherein said mop device is also powered by said power source of said suction means, wherein one end of said central axle is rotatably connected to an output axle of said power source via a rotary gear unit so as to drive said mop roller to rotate automatically.

24. The glass surface cleaning machine, as recited in claim 23, wherein said mop device further comprises means for retaining said rotary gear unit in a rotatably engaging manner.

25. The glass surface cleaning machine, as recited in claim 22, wherein said mop device further comprises means for retaining said rotary gear unit in a rotatably engaging manner.

26. The glass surface cleaning machine, as recited claim 1, further comprising an operation device which includes an extension frame and a control means for controlling said vacuum device, wherein said extension frame is detachably attached to a rear portion of said supporting frame to extend a handle portion of said supporting frame and said control means comprises a rechargeable power supply disposed in said extension frame and electrically connected to said power source of said suction means, and a control switch for selectively controlling said power source in an on and off manner.

27. The glass surface cleaning machine, as recited in claim 1, further comprises a fluid spray device which comprises at least a fluid detergent supply bin supported by said supporting frame, at least a spray head mounted on said supporting arm and operatively communicating with said fluid detergent supply bin via a conduit, and an operation trigger arranged to be operated for ejecting fluid detergent in said fluid detergent supply bin through said spray head.

28. The glass surface cleaning machine, as recited claim 27, further comprising an operation device which includes an extension frame and a control means for controlling said vacuum device, wherein said extension frame is detachably attached to a rear portion of said supporting frame to extend a handle portion of said supporting frame and said control means comprises a rechargeable power supply disposed in said extension frame and electrically connected to said power source of said suction means, and a control switch for selectively controlling said power source to power on and off.

29. The glass surface cleaning machine, as recited in claim 1, further comprising a mop device which comprises a mop roller transversely and rotatably mounted underneath said supporting arm, wherein said mop roller comprises an elongated central axle rotatably supported underneath said supporting arm and a mopping element encircling said central axle.

30. The glass surface cleaning machine, as recited in claim 29, wherein said mop device is also powered by said power source of said suction means, wherein one end of said central axle is rotatably connected to an output axle of said power source via a rotary gear unit so as to drive said mop roller to rotate automatically.

31. The glass surface cleaning machine, as recited in claim 30, wherein said mop device further comprises means for retaining said rotary gear unit in a rotatably engaging manner.

32. The glass surface cleaning machine, as recited in claim 29, wherein said mop device further comprises means for retaining said rotary gear unit in a rotatably engaging manner.

* * * * *